US009428861B2

(12) United States Patent
Consolato et al.

(10) Patent No.: US 9,428,861 B2
(45) Date of Patent: Aug. 30, 2016

(54) DEVICE FOR MANUFACTURING A MATERIAL WEB

(71) Applicant: VOITH PATENT GMBH, Heidenheim (DE)

(72) Inventors: Robson Consolato, Sao Paulo (BR); Marco Brujas, Sao Paulo (BR)

(73) Assignee: Voith Patent GmbH, Heidenheim (DE)

( * ) Notice: Subject to any disclaimer, the term of this patent is extended or adjusted under 35 U.S.C. 154(b) by 101 days.

(21) Appl. No.: 14/365,758

(22) PCT Filed: Dec. 11, 2012

(86) PCT No.: PCT/EP2012/075019

§ 371 (c)(1),
(2) Date: Jun. 16, 2014

(87) PCT Pub. No.: WO2013/087597

PCT Pub. Date: Jun. 20, 2013

(65) Prior Publication Data

US 2015/0129149 A1 May 14, 2015

(30) Foreign Application Priority Data

Dec. 14, 2011 (DE) ..... 10 2011 088 513
Dec. 14, 2011 (DE) ..... 20 2011 109 246 U

(51) Int. Cl.
*D21F 5/02* (2006.01)
*D21F 5/06* (2006.01)
*F26B 13/18* (2006.01)

(52) U.S. Cl.
CPC ..... *D21F 5/06* (2013.01); *D21F 5/021* (2013.01); *F26B 13/18* (2013.01)

(58) Field of Classification Search
CPC ..... D21F 3/0281; D21F 5/00; D21F 5/004; D21F 5/02; D21F 5/021; D21F 5/027; D21F 5/028; D21F 5/06; D21F 5/181; D21F 5/184; D21G 1/0253; D21G 1/0286; F26B 13/14; F26B 13/145; F26B 13/18
USPC ..... 162/206, 207, 199, 272, 359.1, 375; 34/108, 110, 602, 603, 611, 618, 623
See application file for complete search history.

(56) References Cited

U.S. PATENT DOCUMENTS 4,385,453 A * 5/1983 Withers, Jr. ..... F26B 13/183 165/89
4,399,169 A * 8/1983 McGowan ..... D21F 5/021 138/109

(Continued)

FOREIGN PATENT DOCUMENTS

DE 3023298 A1 1/1982
WO 8203909 A1 11/1982

(Continued)

*Primary Examiner* — Eric Hug
(74) *Attorney, Agent, or Firm* — Laurence A. Greenberg; Werner H. Stemer; Ralph E. Locher

(57) ABSTRACT

A device for manufacturing, processing or finishing a web-shaped material web, in particular a fiber-material, paper, tissue or cardboard web, includes an interior space and a housing which, at least in part, surrounds the interior space and has an inner face and an outer face. The interior space has a temperature which is different from that of the surroundings of the housing, and the inner face and/or the outer face, at least in partial-regions, is/are provided with a thermal-insulation layer composed of at least one coating.

12 Claims, 2 Drawing Sheets

(56) References Cited

U.S. PATENT DOCUMENTS 5,123,152 A * 6/1992 Tenkula ..... D21F 5/021 162/357
5,252,185 A * 10/1993 Ellis ..... D21G 1/00 100/330
5,327,661 A * 7/1994 Orloff ..... D21F 3/0281 162/289
5,667,641 A * 9/1997 Poirier ..... D21F 5/021 162/207
6,338,366 B1 * 1/2002 Williams ..... F16L 59/145 138/146
6,623,601 B2 * 9/2003 Graf ..... B29C 70/84 162/272
8,398,822 B2 3/2013 Mennucci et al.
2002/0060023 A1 * 5/2002 Kaihovirta ..... D21F 5/04 162/207
2003/0181303 A1 * 9/2003 Leinonen ..... D21F 5/022 492/46
2010/0132903 A1 * 6/2010 Mennucci ..... D21F 5/021 162/357

FOREIGN PATENT DOCUMENTS

WO 9715720 A1 5/1997
WO 2006010793 A2 2/2006
WO 2011030363 A1 3/2011
WO WO 2011/030363 * 3/2011

* cited by examiner

DEVICE FOR MANUFACTURING A MATERIAL WEB

BACKGROUND OF THE INVENTION

1. Field of the Invention

The invention relates to a device for manufacturing, processing or finishing a web-shaped material web, in particular a fiber-material, paper, tissue or cardboard web, having an interior space and a housing which, at least in part, surrounds the former and which has an inner face and an outer face, wherein the interior space has a temperature which is different from that of the surroundings of the housing, and the inner face and/or the outer face, at least in part-regions, is/are provided with a thermal-insulation layer.

Devices of this type are known. Document WO2011/030363 A1 discloses a Yankee drying cylinder for a paper-making machine, having an insulation of the end covers. The insulation may be constructed from a plurality of segments. The segments are composed of an insulating metal sheet having insulation material applied. Mineral wool and glass wool are proposed as an insulation material. The segments are screwed to a connection ring which, in turn, is connected to the end cover.

It is also known for pipelines and drying hoods in paper-making machines, in particular in the region of drying sections, to be insulated using glass wool or mineral wool.

This type of insulation requires a high complexity for the casing of the insulation material, in particular in the region of a paper-making or tissue-making machine, in order to offer protection from the wet and from mechanical influences and emissions.

2. Brief Summary of the Invention

The object of the invention is to improve the known solutions with respect to the insulation of components in paper manufacturing.

The object is achieved by a device for manufacturing, processing or finishing a web-shaped material web, in particular a fiber-material, paper, tissue or cardboard web, having an interior space and a housing which, at least in part, surrounds the former. The housing has an inner face and an outer face, wherein the interior space has a temperature which is different from that of the surroundings of the housing, and the inner face and/or the outer face, at least in part-regions, is/are provided with a thermal-insulation layer. According to the invention, the thermal-insulation layer comprises at least one coating. The advantage of this solution lies in that the coating can be applied in a cost-effective manner and, for example as a result of an adhering effect or adhesive effect of the coating material, is fixedly connected to the inner face and/or outer face of the housing. Construction complexity for attaching the thermal-insulation layer is likewise reduced. The coating is preferably composed of a plurality of material components which, after application, form a solid layer on the housing, for example by way of curing. The coating is water-resistant and thus, in contrast to glass wool or mineral wool, immune to water and steam. When coming into contact with water, the insulating effect is affected only insignificantly. The coating, even in the case of a prolonged service, does not emit any substances which are harmful to humans. On account of the implementation of a coating as a thermal insulation, a further advantage lies in a possible simple construction of the insulating design.

It is furthermore possible to apply a plurality of layers of the coating on top of one another. This may be advantageous in the case of greater layer thicknesses, for example in the case of a layer thickness of more than 6 mm. Different layer compositions may also be combined in the case of the multi-layered application approach. For example, the cover layer may comprise a watertight layer or a layer without cavities.

In one practical embodiment, the coating comprises cavities. The cavities may be completely or partially closed. The cavities are preferably filled with air or other gases having low thermal conductivity. This improves the insulating effect. The coating may have a foam-type construction.

The volume of the cavities of the coating advantageously has a volumetric proportion of 15% to 30%, preferably of 20% to 22%.

The coating, at least in part, preferably comprises ceramic material, on account of which the coating is non-combustible and non-flammable.

The coating, at least in part, expediently comprises a binding agent, in particular an acrylic compound, for connecting the material components and for generating the adhering force and adhesive force to the inner face and/or the outer face of the housing. On account thereof, the coating becomes flexible. Thermal expansions in length of the carrier material do not lead to damage to the insulation layer, such as peeling and cracking. Moreover, the adhering effect of the coating to almost all materials which may be considered is adequate.

Apart from the ceramic material and the binding agent, even further materials may be contained in the coating material.

In one practical embodiment, the coating is applied to the housing by way of a spray method. Here, air is preferably embedded into the coating layer.

The layer thickness of the coating advantageously lies in a range from 2 mm to 10 mm, in particular in a range from 3.5 mm to 6 mm, preferably in the range from 3.5 mm to 4.5 mm. Depending on the type of application, layer thicknesses of greater than 10 mm are likewise possible.

In one practical example, the housing comprises a sleeve, in particular a roller sleeve, and end covers, attached on both sides, having bearing journals, wherein the housing is preferably configured as a drying cylinder, in particular as a Yankee drying cylinder.

It is also conceivable for the housing to be embodied as a cooling cylinder of a paper-making machine. Cooling cylinders are employed, for example, at the end of the drying section of a paper-making machine, in particular as the last cylinder, for cooling the paper web. Here, the temperature in the interior of the cooling cylinder is below the ambient temperature.

For the purpose of drying or cooling, drying cylinders and cooling cylinders in paper-making machines are sometimes wrapped in direct contact with the fiber-material web. Here, the width of the fiber-material web is less than the length of the drying cylinders and cooling cylinders. Heat loss arises in those peripheral regions that are not covered by the paper web.

In one preferred embodiment, the housing comprises a drying cylinder, in particular a Yankee drying cylinder, having a diameter of more than 3 m, in particular more than 4 m. Yankee drying cylinders are employed in tissue-making machines for drying the tissue web. On account of the large face of the end cover and the high heat loss resulting therefrom, the invention can be particularly advantageously employed here.

For the purpose of drying and cooling, drying cylinders and cooling cylinders in paper-making machines are sometimes wrapped in direct contact with the fiber-material web. Here, the width of the fiber-material web is less than the length of the drying cylinders and cooling cylinders. Therefore, heat loss arises in those peripheral regions that are not covered by the paper web. Therefore, in the case of specific applications, the coating may be applied in an annular manner in a region in the interior space, in that region of the axial ends of the sleeve of the drying cylinder that extends beyond the width of the fiber-material web.

In specific cases it is possible for the end covers, on the inner side and/or on the outer side, to be provided with the thermal-insulation layer.

According to a further practical embodiment, at least one end cover comprises an inner cover and an outer cover. Both covers are connected to one another, for example screwed or welded to one another. However, it is particularly advantageous for the inner and the outer covers to be releasably connected to one another. Advantageously, both end covers of the roller or of the drying cylinder or of the cooling roller comprise an inner and an outer cover.

The outer cover expediently comprises a multiplicity of segments, preferably more than 2 segments, in particular more than 8 segments. In the case of large roller diameters or drying-cylinder diameters, 10 segments and more are advantageous. On account of the smaller construction size and the smaller weight thereby achieved, handling of the segments during manufacturing, assembly and coating becomes easier. Therefore, the coating may be readily applied to the segments and prepared under optimal conditions, such as, for example, temperature, humidity, outside of the paper-making machine or tissue-making machine, in the workshop. Occupational safety measures, such as, for example, extraction by suction during application of the coating, can be carried out in a simple manner.

Advantageously, the outer cover, on the inner side and/or on the outer side, is provided with the thermal-insulation layer.

In one preferred embodiment, the segments of the outer cover have webs, which preferably run radially, for increasing mechanical stability. The segments are manufactured from steel sheet, preferably from stainless special-steel sheet, wherein the webs are advantageously produced by edge-bending of the segment steel sheet about a radial bending line. When assembling the outer cover, at least part of the adjacent webs of the segments can be screwed together. On account thereof, a stable interconnection is produced, in particular in the case of drying cylinders or rollers having a large diameter. Additionally or alternatively to screwing the webs, radially oriented strips, which are screwed to the segments and overlap both segments, may be provided in the region of the abutting faces of adjacent segments.

The strips may advantageously be embodied having webs and be screwed or welded to the segments. These strips have a T-shaped cross section.

In a refined embodiment, the radially oriented strips may be welded to one of the adjacent segments and be screwed to the other. This reduces manufacturing costs and assembly time.

In one practical embodiment, the sleeve, on its ends, is screwed and/or welded to the end covers. In particular in the case of rollers or drying cylinders made of steel, cost advantages result on account of welding as opposed to screwing. In the case of screwing, the end covers have an outer flange which is screwed to the sleeve.

In the case of an embodiment of the end covers in two parts, it is advantageous for the outer cover to be screwed to the inner cover. This is particularly relevant when the outer cover is formed from segments. Since the thermal-insulation layer is embodied as a coating and comparatively little construction space is required, the segments, on their radially outer end, may be directly screwed onto the inner cover, without using an additional intermediate ring. Segmenting simplifies the complexity of assembly and disassembly for the outer cover in the case of maintenance work in the interior of the drying cylinder or of the roller, since only one segment which is assigned to the manhole of the drying cylinder has to be removed.

According to a preferred further embodiment, the inner cover of at least one end cover comprises an opening, and one segment of the outer cover has a marking for identification of the position of the opening, for example of a manhole. When assembling the outer cover, the segment having the marking is expediently disposed in an aligned manner with the opening. On account thereof, the disassembly complexity of the outer cover is likewise minimized in the case of maintenance work in the interior of the drying cylinder or of the roller, since only the one segment that is aligned with the opening and/or assigned to the opening has to be removed for the ingress of operators.

BRIEF DESCRIPTION OF THE SEVERAL VIEWS OF THE DRAWING

Further features and advantages of the invention are obtained from the following description of preferred exemplary embodiments, with reference to the drawings, in which.

DESCRIPTION OF THE INVENTION

Figure 1:
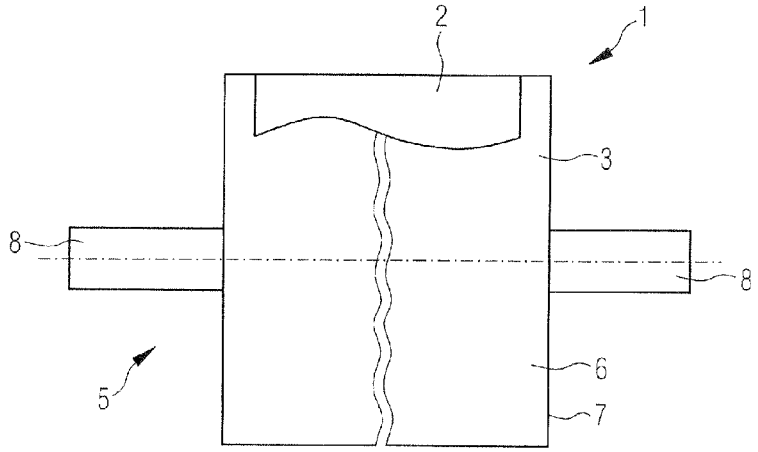
FIG. 1 shows a simplified illustration of an example of a device according to the invention, as an embodiment of a drying cylinder.

FIG. 1 shows a simplified illustration of a device 1 according to the invention in the embodiment of a drying cylinder 5, in particular of a Yankee drying cylinder. The drying cylinder 5 comprises a housing 3 including a sleeve 6 and in each case, on each axial end, one end cover 7 on which bearing journals 8 for the rotatable bearing of the drying cylinder 5 in the paper-making or tissue-making machine are fastened. The end cover 7 and the sleeve 6 form an interior space which is heated by steam to temperatures in the region of 110° C. and more. The thus heated sleeve 6, in part, is wrapped in direct contact by a material web 2 to be dried, in this example by a paper web or tissue web. The width of the material web 2 is less than the length of the sleeve 6. The axial end regions of the sleeve 6, therefore, are not covered by the fiber-material web. Steam is guided into the interior space of the drying cylinder 5 via a bearing journal 8. The steam condensate created by the drying operation is likewise guided out of the drying-cylinder interior space again via a bearing journal 8.

Figure 2:
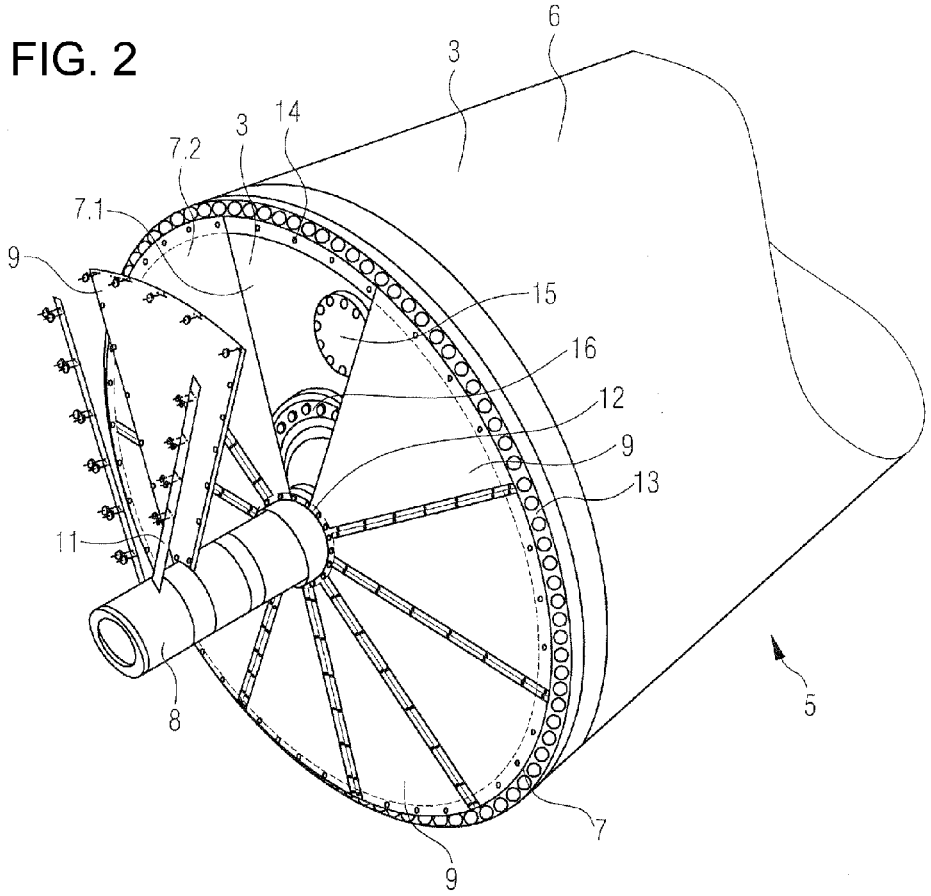
FIG. 2 shows an exemplary embodiment of a drying cylinder having an end cover in two parts and having an outer cover comprising a plurality of segments.

In FIG. 2, an exemplary embodiment of an axial end of a drying cylinder 5 as per FIG. 1 is shown in a perspective illustration. The end cover 7, 7.1, 7.2 is embodied in two parts and comprises an inner cover 7.1 and an outer cover 7.2 comprising a plurality of segments 9. The inner cover 7.1 has an outer flange 13 which is screwed to the sleeve 6 of the drying cylinder 5. The segments 9 of the outer cover 7.2, on their outer circumference, are directly screwed to the outer flange 13 and, in the region of their inner circumference to an inner flange 12 connected to the bearing journal 8. The inner cover 7.1 has an opening, which is referred to as a manhole 15, which enables access to the interior space of the drying cylinder 5 for maintenance work. The position of the manhole 15 is marked on a segment 9 or on the visible part of the inner end cover 7.1. One or more segments 9 of the outer cover 7.2 are disposed in such a manner during assembly that access to the manhole 15 is possible by way of removal of the one or more segments 9. The segments 9 of the outer cover 7.2 have webs 10, which preferably run radially, for increasing mechanical stability. The segments 9 are manufactured from steel sheet, preferably from stainless special-steel sheet, wherein the webs 10 are advantageously produced by edge-bending of the segment steel sheet about a radial bending line. When assembling the outer cover 7.2, at least part of the adjacent webs 10 of the segments 9 can be screwed together. On account thereof, a stable interconnection is produced, in particular in the case of drying cylinders having large diameters. Additionally or alternatively to screwing the webs 10, externally disposed, radially oriented strips 11, which are screwed to the segments 9 and overlap both segments 9, are provided in the region of the abutting faces of adjacent segments 9. In an embodiment not illustrated, the strips 11 may be embodied having webs 10 and be screwed or welded to the segments 9. These strips 11 have a T-shaped cross section. In one refined embodiment, the radially oriented strips 11 are welded to one of the adjacent segments 9 and screwed to the other. This reduces manufacturing costs and assembly time. The bearing journals 8 are connected to the end covers 7 with a flange 16. In the case of an embodiment of the end covers 7.1, 7.2 in multiple parts, the latter are connected to the inner covers 7.1 with a flange 16.

Figure 3:
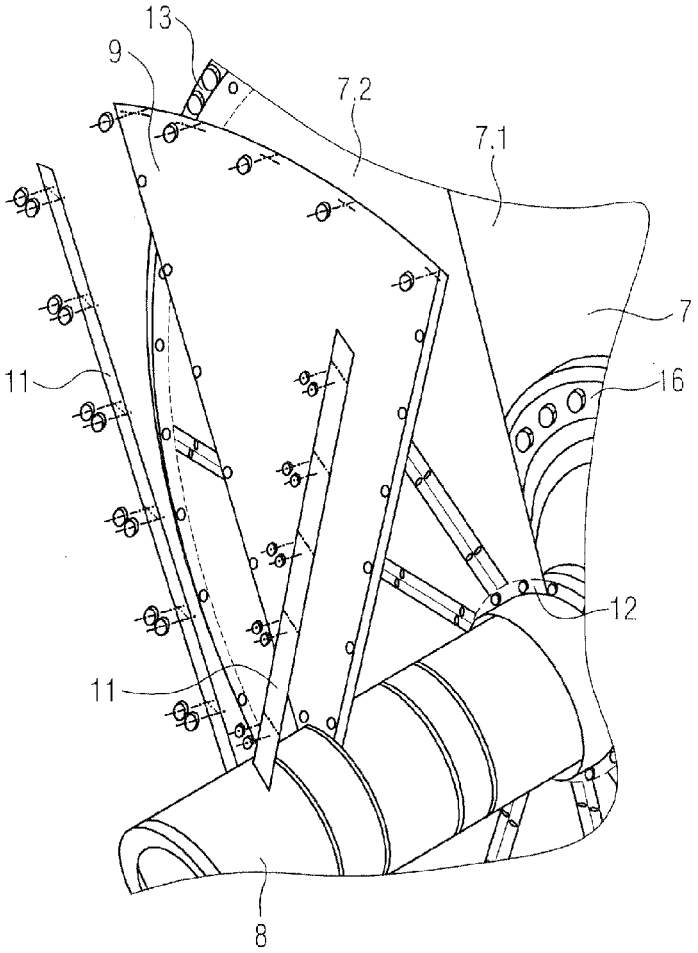
FIG. 3 shows a detail of the exemplary embodiment illustrated in FIG. 2.

FIG. 3 shows a detail of the exemplary embodiment illustrated and described in FIG. 2.

Figure 4:
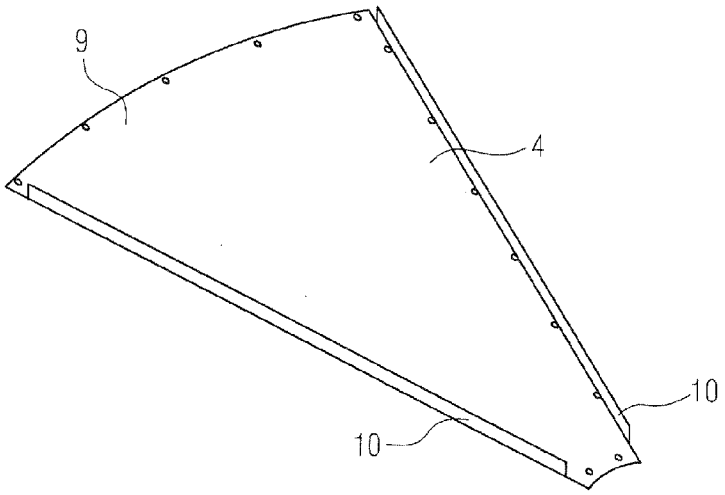
FIG. 4 shows a segment having a coating applied to the inner side.

FIG. 4 shows a segment 9 having a coating 4 applied as a thermal-insulation layer to the inner side, that is to say to the side facing the drying cylinder 5. For the purpose of mechanical stabilization, webs 10, which have been produced by edge-bending in the direction of the inner side, are present on both radially running sides of the segment 9. The lengths of the webs 10 are shorter than the radial length of the edges of the segment 9. In order to ensure a stable connection of the segments 9 to the drying cylinder 5, the webs 10, in the region of the connection to the inner flange 12 and the outer flange 13, are recessed.

LIST OF REFERENCE SIGNS

1 Device
2 Material web
3 Housing
4 Thermal-insulation layer, coating
5 Drying cylinder
6 Sleeve
7 End cover
7.1 Inner cover
7.2 Outer cover
8 Bearing journal
9 Segment
10 Web
11 Strip
12 Inner flange
13 Outer flange
14 Tapped bores
15 Manhole
16 Flange for bearing journal

The invention claimed is:

1. A device for manufacturing, processing or finishing a web-shaped material web including a fiber-material, paper, tissue or cardboard web, the device comprising:

a housing being a drying cylinder having an inner face and an outer face and defining surroundings of said housing, and said housing including a sleeve having sides and end covers each attached to a respective one of said sides;

said end covers each having a respective bearing journal, at least one of said end covers including an inner cover and an outer cover, said inner cover having an opening formed therein, said outer cover including a multiplicity of segments, one of said segments of said outer cover having a marking for identification of a position of said opening, and said outer cover having an inner side and an outer side;

an interior space at least partly surrounded by said housing, said interior space having a temperature different than a temperature of said surroundings of said housing; and a thermal-insulation layer disposed at least in partial regions of at least one of said inner face or said outer face, said thermal-insulation layer being disposed on at least one of said inner side or said outer side of said outer cover, and said thermal-insulation layer including at least one coating;

said at least one coating including cavities and having a volume, and said cavities having a volume being 15% to 30% of said volume of said coating and a layer thickness range selected from the group consisting of 2 mm to 10 mm, 3.5 mm to 6 mm, and 3.5 mm to 4.5 mm.

2. The device according to claim 1, wherein said coating has a volume, and said cavities have a volume being 20% to 22% of said volume of said coating.

3. The device according to claim 1, wherein said coating is partially formed of ceramic material.

4. The device according to claim 1, wherein said coating is at least partially formed of a binding agent.

5. The device according to claim 4, wherein said binding agent is an acrylic compound.

6. The device according to claim 1, wherein said end covers have an inner side and an outer side, and said thermal-insulation layer is disposed on at least one of said inner side or said outer side.

7. The device according to claim 1, wherein said multiplicity of segments is more than 2 segments or more than 8 segments.

8. The device according to claim 1, wherein said segments of said outer cover have webs for increasing mechanical stability.

9. The device according to claim 1, wherein said sides of said sleeve are at least one of screwed or welded to said end covers.

10. The device according to claim 1, wherein said outer cover is screwed to said inner cover.

11. The device according to claim 1, wherein said opening is a manhole.

12. A device for manufacturing, processing or finishing a web-shaped material web including a fiber-material, paper, tissue or cardboard web, the device comprising:

a housing having an inner face, an outer face and a sleeve having sides and end covers each attached to a respective one of said sides;

said end covers each having a respective bearing journal, at least one of said end covers including an inner cover and an outer cover, said inner cover having an opening formed therein, said outer cover having a marking for identification of a position of said opening, and said outer cover having an inner side and an outer side;

an interior space at least partly surrounded by said housing, said interior space having a temperature different than a temperature of said surroundings of said housing; and a thermal-insulation layer disposed at least in partial regions of at least one of said inner face or said outer face, said thermal-insulation layer being disposed on at least one of said inner side or said outer side of said outer cover, and said thermal-insulation layer including at least one coating.

* * * * *